US006511360B1

(12) United States Patent
Lyman

(10) Patent No.: US 6,511,360 B1
(45) Date of Patent: Jan. 28, 2003

(54) PENDULUM DRIVEN ANIMATED FIGURINE

(76) Inventor: Ronald Lee Lyman, 235 Cascade Falls Dr., Folsom, CA (US) 95630

( * ) Notice: Subject to any disclaimer, the term of this patent is extended or adjusted under 35 U.S.C. 154(b) by 0 days.

(21) Appl. No.: 09/873,003

(22) Filed: Jun. 1, 2001

(51) Int. Cl.[7] ..... A63H 13/18; A63H 15/06

(52) U.S. Cl. ..... 446/325; 446/326; 446/351; 40/485

(58) Field of Search ..... 446/129, 130, 446/233, 234, 325, 326, 351; 40/485, 426, 421, 418, 419

(56) References Cited

U.S. PATENT DOCUMENTS

| | | | | | |
|---|---|---|---|---|---|
| 83,160 | A | * | 10/1868 | Holt | 446/326 |
| 298,290 | A | | 5/1884 | Crandall | |
| 390,483 | A | * | 10/1888 | Laskey | 446/326 |
| 444,088 | A | * | 1/1891 | Dickinson | 446/315 |
| 932,988 | A | * | 8/1909 | Larson | 273/140 |
| 1,127,388 | A | * | 2/1915 | Banovitch et al. | 446/326 |
| 1,148,266 | A | * | 7/1915 | Wachtelschneider | 248/215 |
| 1,226,835 | A | | 5/1917 | Wilder | |
| 1,319,379 | A | * | 10/1919 | Deemer | 446/326 |
| 1,766,282 | A | | 6/1930 | Colbert | |
| 1,996,600 | A | * | 4/1935 | Vass | 119/900 |
| 2,032,889 | A | | 3/1936 | Ruckelshaus | |
| D104,746 | S | | 6/1937 | Rambacher | |
| 2,127,316 | A | | 8/1938 | Thornton-Norris | |
| 2,186,744 | A | | 1/1940 | Wagenhals | |
| RE21,579 | E | | 9/1940 | Gregory et al. | |
| 2,277,672 | A | | 3/1942 | Stone | |
| 2,551,668 | A | | 5/1951 | Goosmann | |
| 2,598,954 | A | | 6/1952 | Wengel | |
| 2,632,976 | A | | 3/1953 | Donovan | |
| 2,752,730 | A | | 7/1956 | Bellett et al. | |
| 2,781,462 | A | | 2/1957 | Wheeler et al. | |
| 3,417,506 | A | | 12/1968 | Howell | |
| D220,625 | S | | 5/1971 | Macpherson | |
| 3,745,698 | A | | 7/1973 | Davidson | |
| 3,935,666 | A | * | 2/1976 | Absher | 446/325 |
| 4,011,674 | A | | 3/1977 | Jacobson | |
| 4,250,659 | A | | 2/1981 | Ishiguro | |
| 4,414,775 | A | | 11/1983 | Jensen | |
| D288,217 | S | | 2/1987 | Torres et al. | |
| 4,723,233 | A | | 2/1988 | Beebe | |
| 5,377,433 | A | | 1/1995 | Hazlehurst | |
| 5,409,420 | A | | 4/1995 | Setteducati | |
| D364,197 | S | | 11/1995 | Uebergang | |
| 5,483,131 | A | | 1/1996 | Ito | |
| 5,589,721 | A | | 12/1996 | Han et al. | |
| 5,842,902 | A | * | 12/1998 | Liff | 446/130 |
| 5,881,679 | A | | 3/1999 | Hann | |

* cited by examiner

*Primary Examiner*—Jacob K. Ackun
*Assistant Examiner*—Bena B. Miller
(74) *Attorney, Agent, or Firm*—Bernhard Kreten

(57) ABSTRACT

A pendulum and animated figurine having pivot links, some of which are counterbalanced.

73 Claims, 6 Drawing Sheets

PENDULUM DRIVEN ANIMATED FIGURINE

FIELD OF THE INVENTION

The following invention relates generally to kinetic sculptures. More specifically, the instant invention pertains to a powered pendulum which oscillates a mass having pivotal links, some of which are counterbalanced.

BACKGROUND OF THE INVENTION

The following prior art reflects the state of the art known by applicant and is tendered to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| Holt | Oct. 20, 1868 | 83,160 |
| Crandall | May 6, 1884 | 298,290 |
| Banovitch | Feb. 9, 1915 | 1,127,388 |
| Wachtelschneider | July 27, 1915 | 1,148,266 |
| Wilder | May 22, 1917 | 1,226,835 |
| Colbert | June 24, 1930 | 1,766,282 |
| Ruckelshaus | Mar. 3, 1936 | 2,032,889 |
| Rambacher | June 1, 1937 | Des. 104,746 |
| Thomton-Norris | Aug. 16, 1938 | 2,127,316 |
| Wagenhals | Jan. 9, 1940 | 2,186,744 |
| Gregory, et al. | Sept. 24, 1940 | Re. 21,579 |
| Stone | Mar. 31, 1942 | 2,277,672 |
| Goosmann | May 8, 1951 | 2,551,668 |
| Wengel | June 3, 1952 | 2,598,954 |
| Donovan | Mar. 31, 1953 | 2,632,976 |
| Bellett et al. | July 3, 1956 | 2,752,730 |
| Wheeler, et al. | Feb. 12, 1957 | 2,781,462 |
| Howell | Dec. 24, 1968 | 3,417,506 |
| Macpherson | May 4, 1971 | DES. 220,625 |
| Davidson | July 17, 1973 | 3,745,698 |
| Jacobson | Mar. 15, 1977 | 4,011,674 |
| Ishiguro | Feb. 17, 1981 | 4,250,659 |
| Jensen | Nov. 15, 1983 | 4,414,775 |
| Torres, et al. | Feb. 10, 1987 | Des. 288,217 |
| Beebe | Feb. 2, 1988 | 4,723,233 |
| Hazlehurst | Jan. 3, 1995 | 5,377,433 |
| Stetteducati | Apr. 25, 1995 | 5,409,420 |
| Uebergang | Nov. 14, 1995 | Des. 364,197 |
| Ito | Jan. 9, 1996 | 5,483,131 |
| Han, et al. | Dec. 31, 1996 | 5,589,721 |
| Liff | Dec. 1, 1998 | 5,842,902 |
| Hann | Mar. 16, 1999 | 5,881,679 |

The patent to Davidson teaches a magnet operated toy consisting of a base with an aperture across which a string or wire is tightly stretched. A simulated animal has notches in its rear hooves supportingly engaged in the string. The front hooves of the animal consist of permanent magnets and the base has a permanent magnet of polarity mounted thereon which opposes the polarity of the animal's front hooves magnets. Thus, when the animal is initially pivoted on the stretched string or wire and then released, the opposing magnets produce a spring bouncing effect which causes the simulated animal to rock or oscillate.

The patent to Wheeler, et al. teaches an oscillating motor operated by a battery or other electrical source of power. The invention is to provide an oscillating motor that will move back and forth to attract attention.

The patent to Banovitch teaches a toy with a counterbalanced element (10) which is arranged upon a support. The element (10) includes a body (12), a stem (13) projecting from its underside and curved rearwardly from the body, with the stem terminating at its free end in a suitable weight (14) and portions (15) of the body. A moveable member (17) is arranged to swing on the body and includes a suitable weight (18) disposed inside of the body and arranged to swing with the moveable member. When the element 10 is arranged on the support and a forward and backward swinging movement is imparted, the weight 14 on the lower end of the stem will cause the movement to be continued for a considerable length of time.

The patent to Torres, et al. teaches a balancing toy. Particularly of note are FIGS. 2 and 4 through 6.

The patent to Wachtelschneider teaches a toy which includes a weighted rocking support such that when the toy is placed on the edge of a table and given an up and down rocking movement which is maintained by the pendulous action of the weight. In addition, a figure of a rider placed on the animal is also pivoted and weighted and has an individual movement which allows it to rise and descend in the saddle as the animal figure rocks.

The patent to Uebergang teaches a kangaroo toy. FIG. 3 shows a front elevational view which is of interest.

The patent to Hann teaches a magnetic pendulum device for feline amusement and exercise. The device includes a base structure and a support structure extending upwardly from the base structure. A pendulum assembly is connected to the support structure. The pendulum assembly includes an elongate vertical member and a pivot structure secured to a top portion of the elongate vertical member. A first magnet is provided in the base and a second magnet is disposed adjacent a bottom of a toy member which is secured to a bottom portion of the elongate vertical member. A downwardly facing portion of the second magnet has a magnetically repelling polarity to a polarity of an upwardly facing portion of the first magnet.

The patent to Ishiguro teaches a pendoulously supported magnetically actuated figurine including a supporting structure, a magnet disposed in the base of said supporting structure, an object having a coacting magnet attached thereto, and means for pendoulously suspending the object from the base structure in a position to swing the respective magnets opposed. Thus, the object has a center of gravity off-axis to the force between the opposed magnets in combination with a segment of the support capable of receiving and storing torsional energy.

The other prior art listed above but not specifically described teach other amusement devices and further catalog the prior art of which the applicant is aware.

The instant invention diverges even more starkly from them.

SUMMARY OF THE INVENTION

The instant invention utilizes a magnetically driven pendulum connected to a figurine so that the figurine moves in opposition to the pendulum about a fulcrum which supports the weight of the pendulum and figurine.

The fulcrum is oriented between the pendulum and figurine and is supported by a base having two upstanding arms, extending to the fulcrum.

The figurine is configured as a mass which rests on the fulcrum. The figurine includes links pivotally attached to the figurine. Some of the links are counterbalanced. As a result, the counterbalanced links do not move in phase with the pendulum/figurine.

OBJECTS OF THE INVENTION

A primary object of the present invention is to provide a kinetic device in which a mass having pivoted links connected thereto move in response to pendulum motion.

Viewed from a first vantage point it is a feature of the present invention to provide an oscillating toy comprising in combination: a pendulum, a mass operatively coupled to the pendulum whereby motion of the pendulum imparts motion to the mass, a fulcrum supporting the mass about which the motion occurs, a link rotationally connected to the mass by a pivot and free to rotate about the pivot in response to pendulum motion, and counterbalance means on the link such that link rotation about the pivot is subject to a time lag due to the counterbalance means.

Viewed from a second vantage point it is a feature of the present invention to provide an oscillating toy comprising in combination: a pendulum having a magnetic element, a mass operatively coupled to the pendulum whereby motion of the pendulum imparts motion to the mass, a fulcrum supporting the mass about which the motion occurs, a link rotationally connected to the mass by a pivot and free to rotate about the pivot in response to pendulum motion, said fulcrum coupled to a base at a different elevation, said base including a magnetic couple to react with the pendulum magnetic element as the pendulum passes over the base.

Viewed from a third vantage point it is a feature of the present invention to provide an oscillating toy comprising in combination: a pendulum, a mass operatively coupled to the pendulum whereby motion of the pendulum imparts motion to said mass, a fulcrum supporting the mass about which the motion occurs, a link rotationally connected the mass by a pivot and free to rotate about the pivot in response to pendulum motion, the mass coupled to the pendulum by an arcuate rod extending therebetween.

Viewed from a fourth vantage point it is a feature of the present invention to provide an oscillating toy comprising in combination: a pendulum, a mass operatively coupled to the pendulum whereby motion of the pendulum imparts motion to the mass, a fulcrum supporting the mass about which the motion occurs, a link rotationally connected to the mass by a pivot and free to rotate about the pivot in response to pendulum motion, the fulcrum formed from a pair of spaced hemispherical cups disposed on a stand upon which the mass is supported, with two pins extending from the mass, one within each cup.

These and other objects will be made manifest when considering the following detailed specification when taken in conjunction with the appended drawing figures.

DESCRIPTION OF PREFERRED EMBODIMENTS

Figures 1, 2:
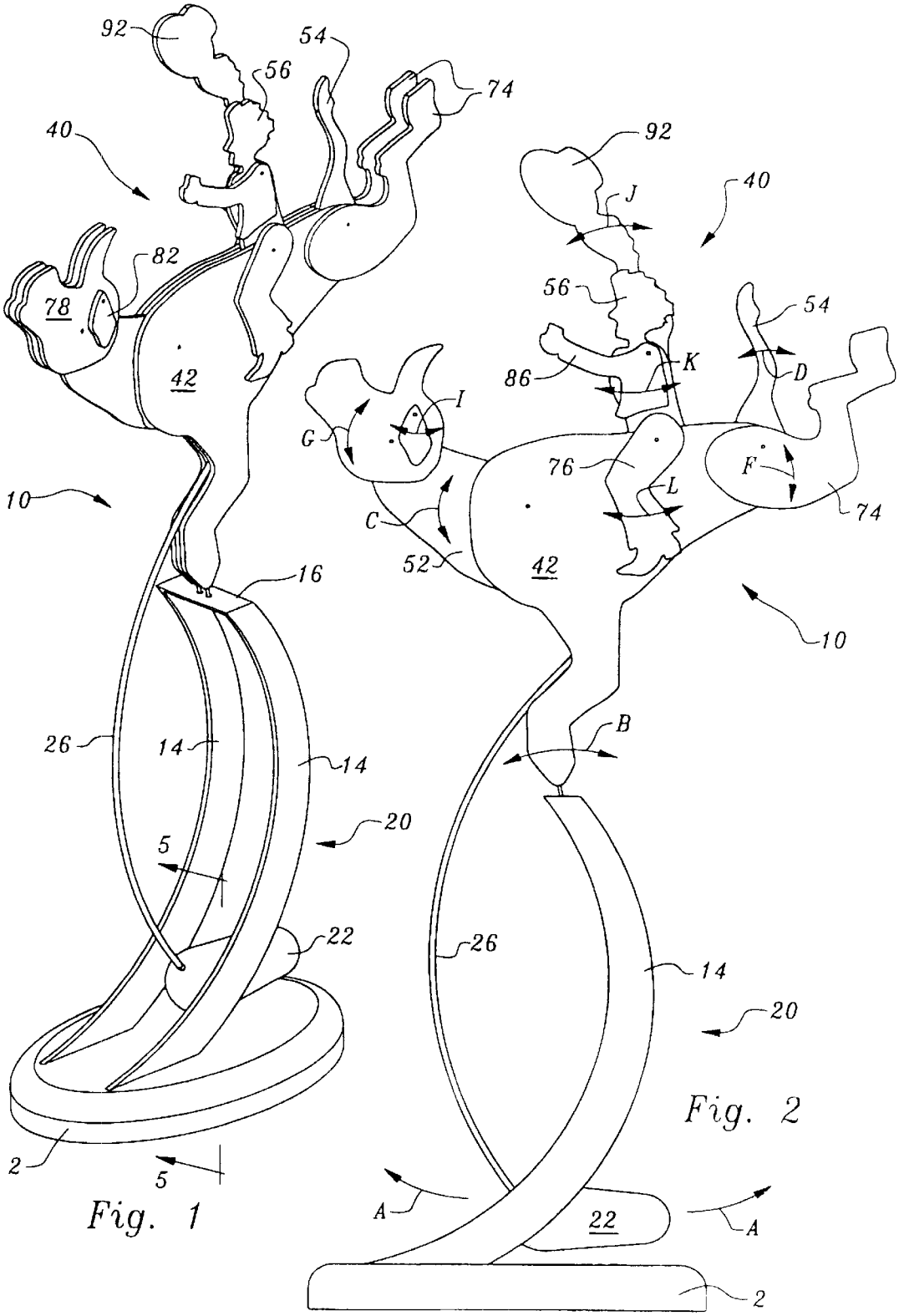
FIG. 1 is a perspective view of a bull and rider.
FIG. 2 is a side view of the bull and rider.

Considering the drawings, wherein like reference numerals denote like parts throughout the various drawing figures, reference numeral 10 is directed to the animated figurine according to the present invention. In essence, the animated figurine 10 includes a stationary part, contoured as a stand 20 (FIGS. 1 and 2, for example) and a moving part 40 configured as a animated figurine.

The stand 20 consists essentially of a base 2 preferably contoured as being substantially oval shaped having a chamfered top peripheral edge and a bottom wall (FIG. 5) contoured with a door 6 within which a battery 4 is disposed. The battery 4 communicates electrically with a magnet 8 via a conductor 12. As a consequence, the magnet 8 induces a field for purposes to be assigned. In addition, the stand 20 includes a pair of spaced parallel arcuate arms 14 which extend up from the base and terminate in a fulcrum 16 formed as a plate of substantially negligible thickness, but deep enough to provide a pair of hemispherical cups 18 formed as depressions within the fulcrum 16. The cups 18 are located on either side of a transverse center line (relative to the long axis of the fulcrum as it extends between the arms 14). These cups 18 receive pins 38 to be discussed hereinafter.

Figure 4:
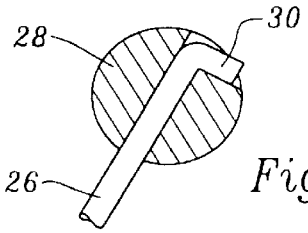
FIG. 4 is a sectional view taken along lines 4—4 of FIG. 3.
Figure 5:
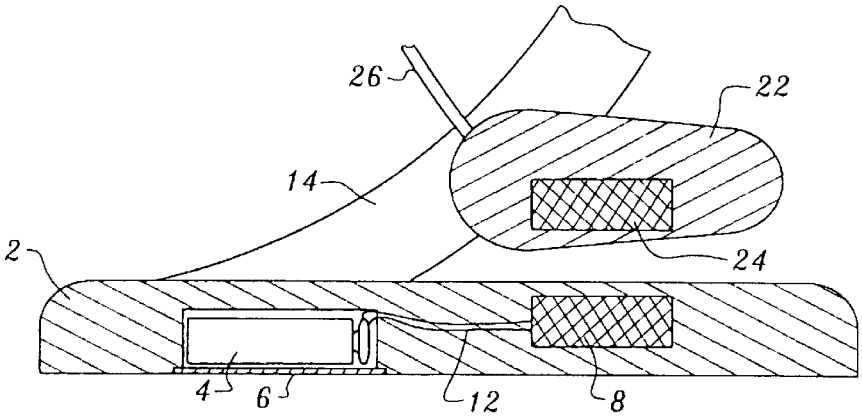
FIG. 5 is a sectional view taken along lines 5—5 of FIG. 1

In FIG. 5, the magnet 8 on the base 2 is electronically coupled to a pendulum 22 having a interior magnet 24 embedded therewithin. Once the pendulum 22 is set in motion as suggested by the double ended arrow A of FIG. 2, the magnet 24 passing through the magnetic field (induced by the battery 4 and magnet 8) causes the moving part 40 to remain in motion for a protracted period of time. The pendulum 22 connects to the moving part 40 by means of a rod 26 which is arcuate in contour and extends from a leading edge of the pendulum 22 upwardly connecting to anchor plug 28 (FIGS. 3 and 4) fixed to the moving part 40.

Figure 3:
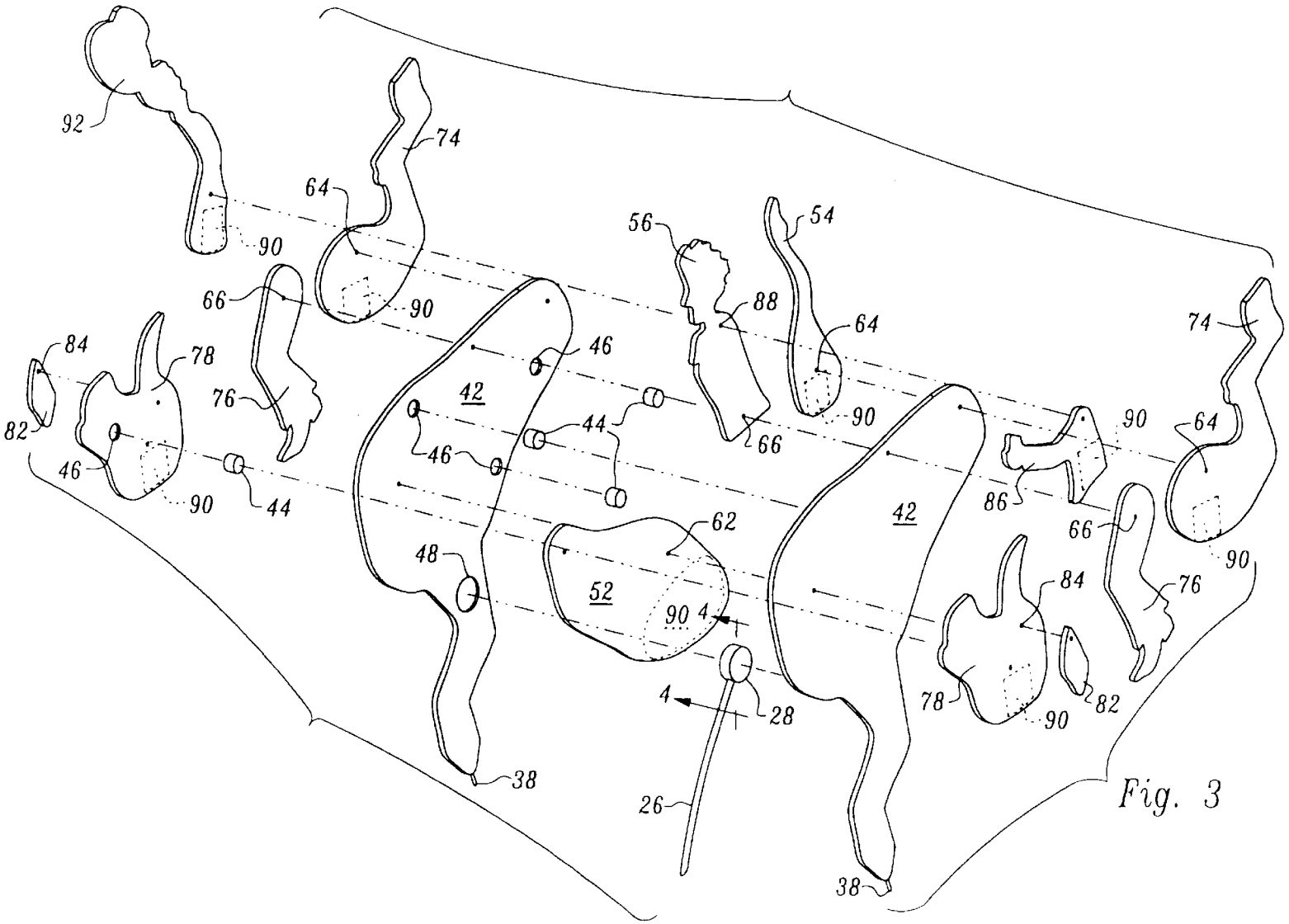
FIG. 3 is an exploded perspective of the bull and rider.

FIGS. 1, 2 3, 8 and 9 are directed to a animated figurine moving part 40 evocative of a bull and bull rider. As a consequence, the bull has an exterior visage evocative of the animal and the bull rider has a motif suggestive of a cowboy, including a cowboy hat. The detail of the moving parts 40 defining the animated figurine can best be explored in FIG. 3 showing the terminal portion of rod 26 as it connects with the animated figurine. Collectively the moving part 40, that is the animated figurine, is generally contoured as a mass having a plurality of pivoted links, some of which are counterbalanced and some of which are pivotally connected so that as the pendulum moves along the direction of the arrow A, (FIGS. 2, 8, 9) the animated figurine also moves in opposition thereto. The links associated therewith will either move with certain time lags programmed therein by the magnitude or absence of counterbalance weights.

Figure 6:
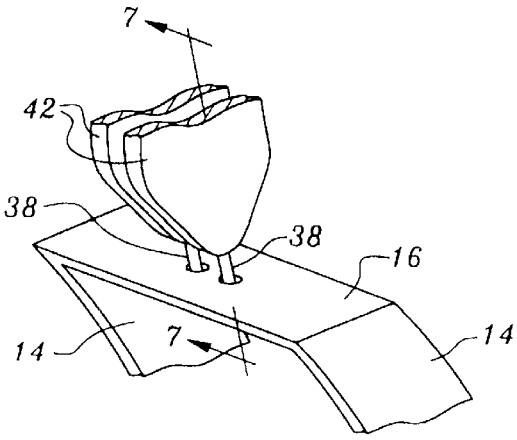
FIG. 6 is a perspective of the fulcrum.

More specifically, and referring to FIG. 3, the animated figurine detail can now be explored. The first piece to be discussed is the mass 42 which defines, at least from an animal's perspective, the front quarter 42 and midsection. The bull has two front quarters which are interconnected by means of three plugs 44 oriented to be received within respective recesses 46 on each quarter. Note also the presence of a larger recess 48 dimensioned to receive the anchor plug 28 therewithin. FIG. 3 show the recesses on one-half of the front quarter 42. Similar recesses are provided on the non-exposed quarter shown in FIG. 3. Thus, the two front quarters can be united yet held in spaced relationship by the thickness of plugs 44 and the anchor plug 28. All of these plugs have similar thickness. The thickness corresponds substantially to the space between the pins 38 shown in FIG. 6. Pins 38 are dimensioned to be placed within the cups 18 discussed hereinabove to allow arcuate motion of the moving part 40 about the arrow B of FIG. 2.

Referring back to FIG. 3, three further elements are sandwiched between the two front quarters. These are the neck 52, the tail 54, and the rider's torso 56. The neck 52 and the tail 54, are arranged to pivotally move about the mass 42 each by its own pivot points 62 and 64 respectively. The torso 56 is fixed in position as by adhesive or the like and does not rotate about point 66. Thus, these elements, the neck, tail and torso are sandwiched between two front quarters with neck and tail allowed to rotate.

Also provided on exterior faces of the mass 42, on each side of the front quarter are other elements similarly pivoted. For example, the rear legs 74 share the common pivot 64 with the tail 54 but are mounted exteriorly on the midsection of each of the front quarters. Note that each front quarter has sufficient dimension to also define the main torso (midsection) of the animal. Similarly, the cowboy 56 has two legs 76 each which are pivoted at point 66, sharing the same point as the cowboy's non-pivoting torso 56 connection.

The remainder of the elements do not connect directly to the front quarter mass 42, but instead connects to "links" which are pivotally connected to the mass. Examples of the links are the neck, tail, torso, rear leg, and cowboy leg. Those elements which connect to the neck include two halves of the bull's face 78. The two halves of the bull's face 78 are interconnected to the neck 52 by means of plugs 44 frictionally and adhesively held within recess 46. This is similar to the arrangement shown for the uniting of the front quarter 42. The bull's face and head 78 each have an ear 82 pivotally connected via pivot 84. Note that the cowboy has two arms, an arm 86 closest to the viewer and an arm 92 supporting a hat at an extremity thereof. Both of these arms are interconnected to the cowboy torso 56 by means of a pivot 88.

As can be imagined, rotation of the pendulum 22 about the double-ended arrow A will cause concomitant movement of the animated figurine in response to and based on its pivotal connection, each of the links will respond somewhat differently. As mentioned, the gross motion of the animated figure will follow the direction of the double-ended arrow B (FIG. 2), above the fulcrum, and the neck 52 will exhibit motion around the direction of the double-ended arrows C, the tail about the double-ended arrow D, the rear legs about the double-ended arrow F, the head about the double-ended arrow G, the ears about the double-ended arrow I, and the arm with the hat about the double-ended arrow J while the other arm about the double-ended arrow K and the leg of the cowboy about the double-ended arrow L.

Figure 14:
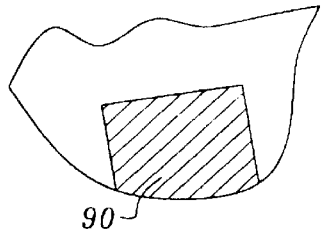
FIG. 14 is a depiction of a counterbalance used in the figurine.
Figure 8:
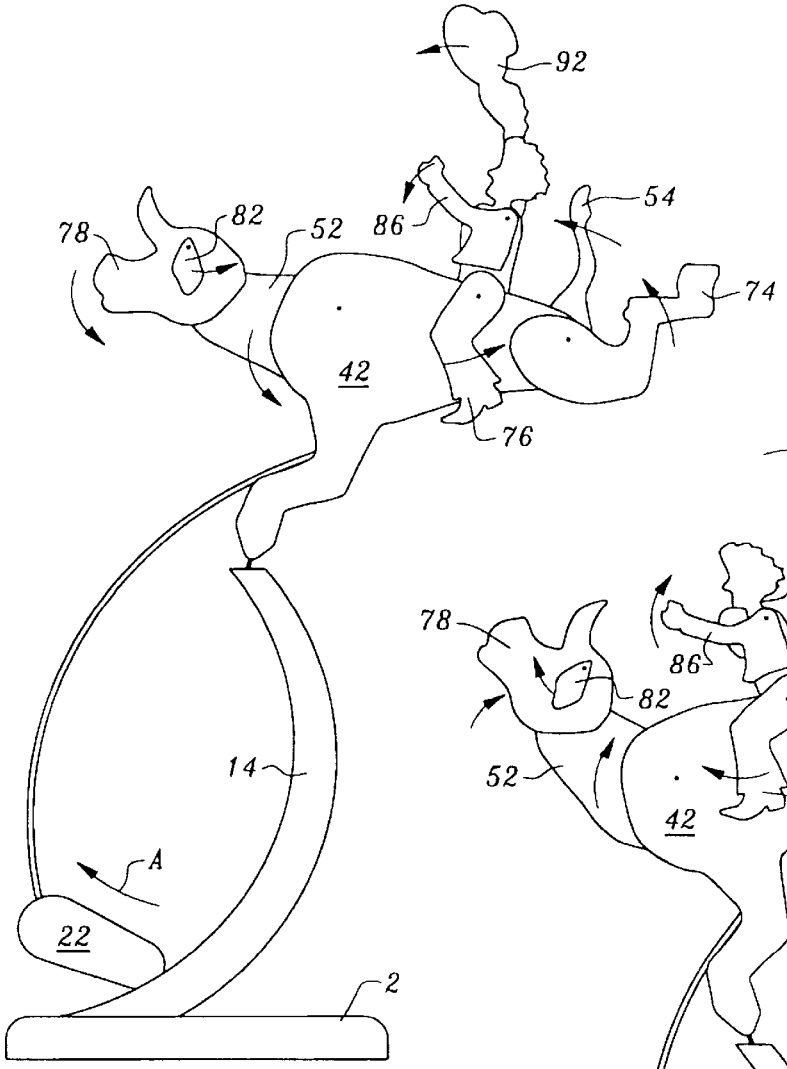
FIG. 8 is a side view of the bull and rider in an extreme position.
Figure 9:
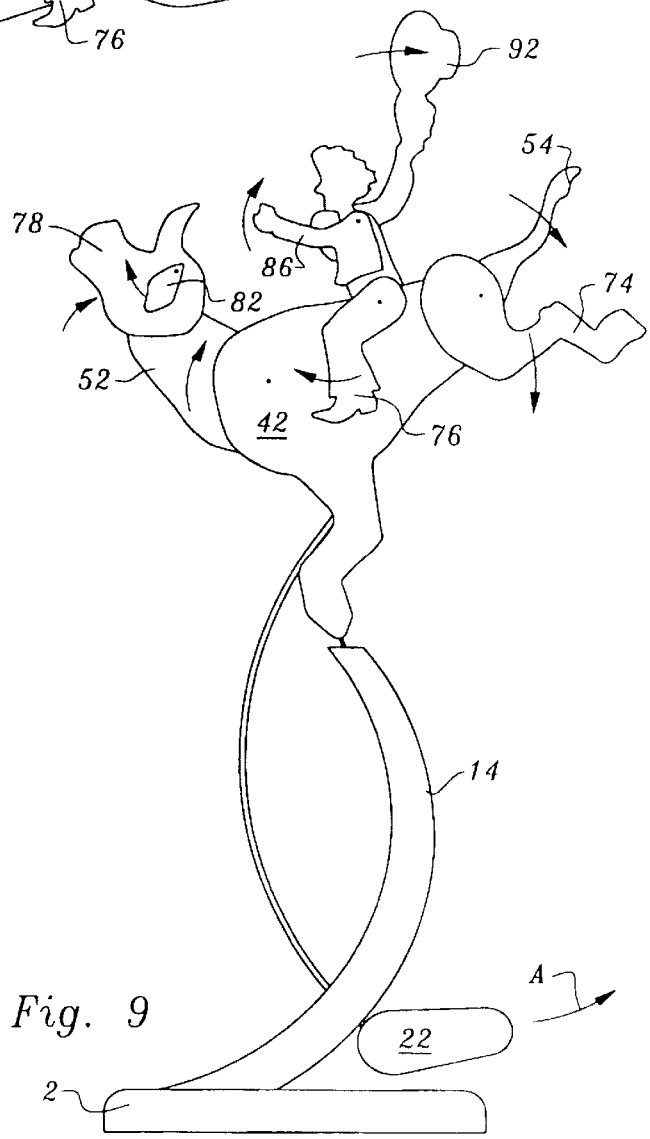
FIG. 9 is a side view of the bull and rider in another extreme position.
Figure 10:
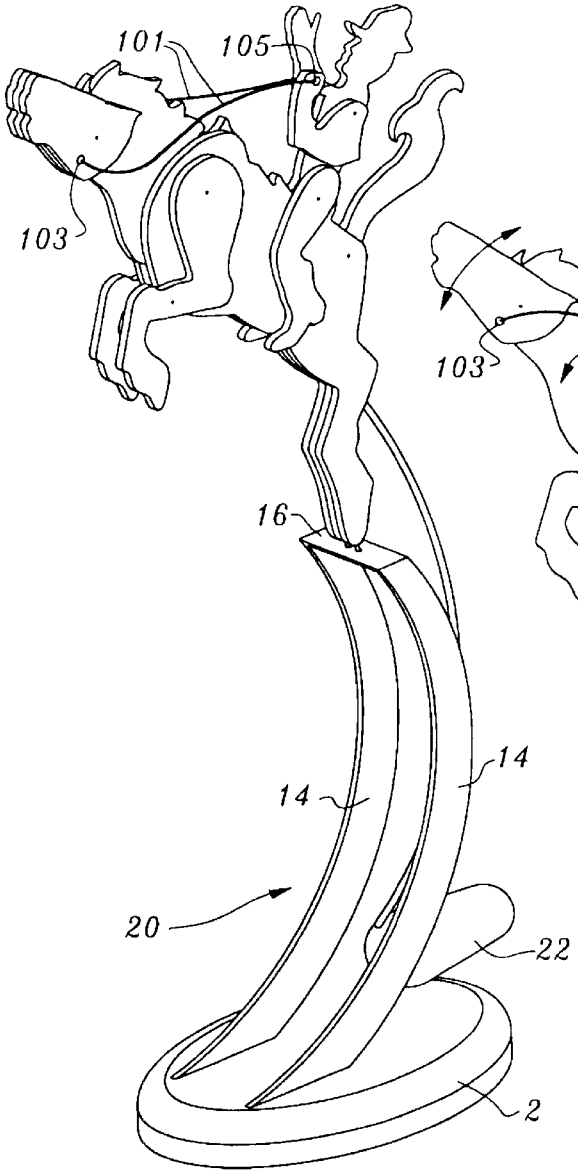
FIG. 10 is a perspective of a bronco and rider.
Figure 11:
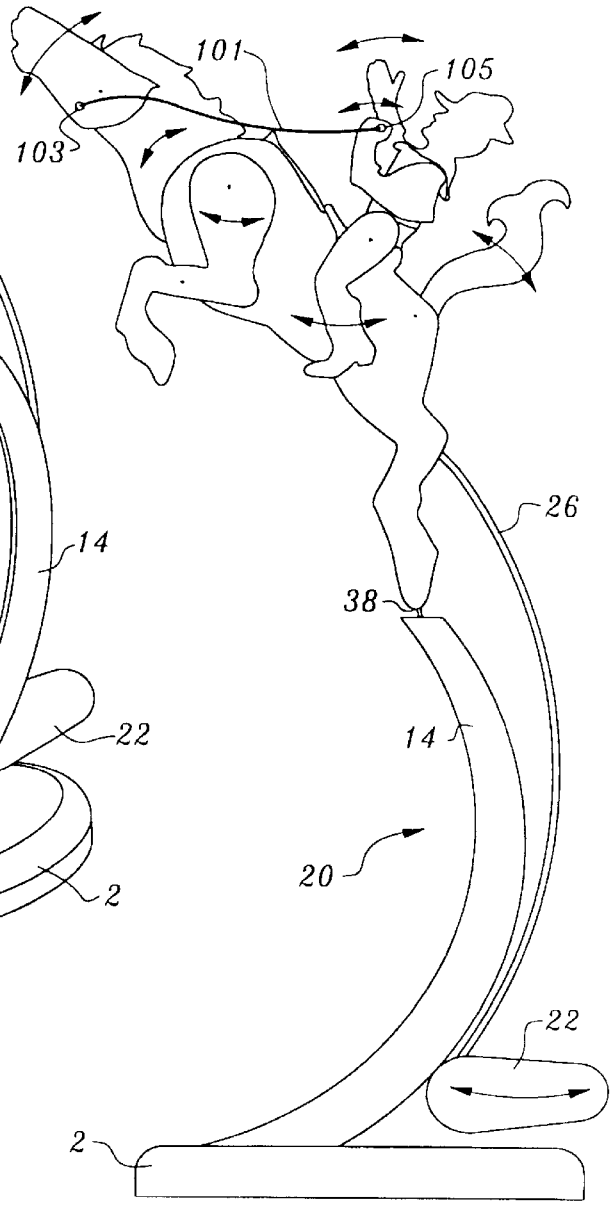
FIG. 11 is a side view of the bronco and rider.
Figure 13:
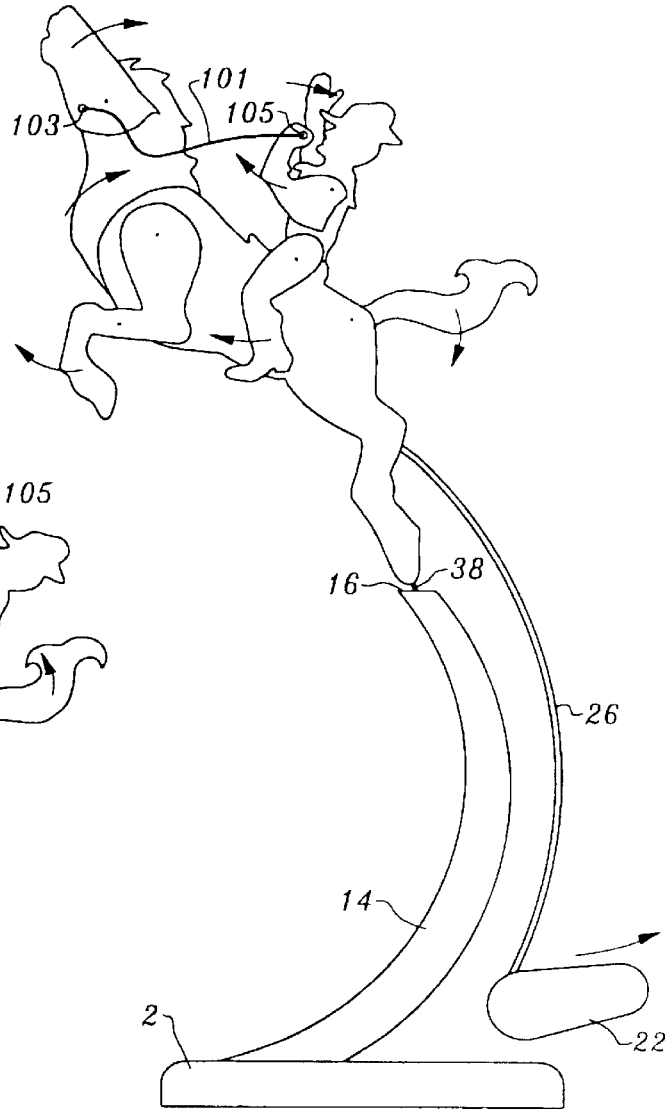
FIG. 13 is a side view of the bronco and rider in an another extreme position.
Figure 12:
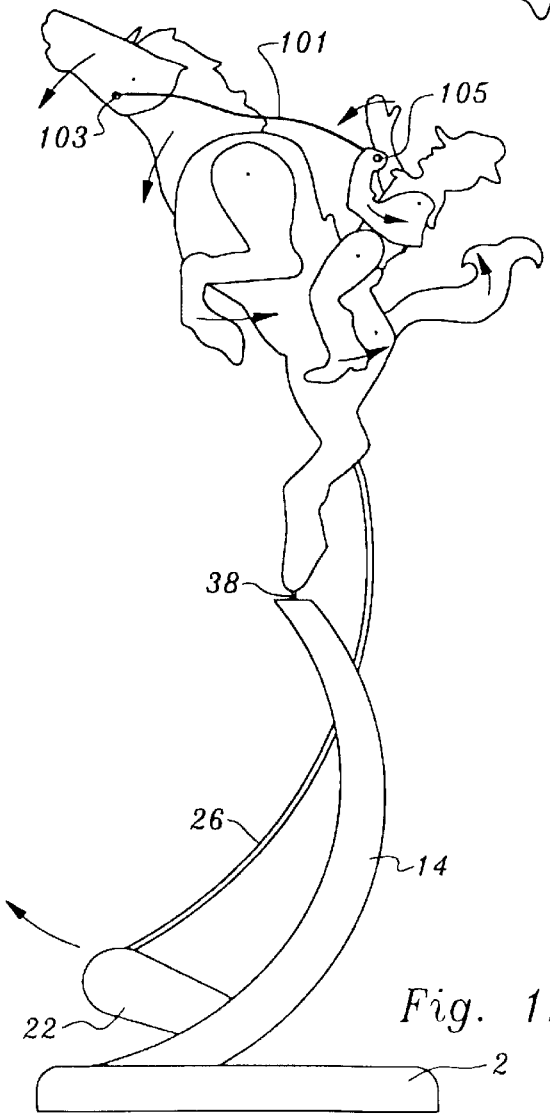
FIG. 12 is a side view of the bronco and rider in an extreme position.

More specifically, and viewing FIGS. 8 and 9, single-ended arrows shown in FIG. 8 show the extreme motion of the bull and rider when the pendulum is in one direction of arrow A and FIG. 9 reflects the motion of the figure when the pendulum is the other direction of the double-ended arrow A. In reviewing these figures, it is apparent that having the legs, neck, head, tail, and arms of the cowboy maintain a position which is not at its lowest energy level is counter-intuitive. The reason that these elements can maintain extended positions which are counter-intuitive occurs by virtue of counterbalances 90 (FIG. 14) which are strategically placed along these links. See for example FIG. 3 where the element 90 shows the judicious placement of several counterbalances in order to provide the counter-intuitive orientation of these elements with respect to their motion.

In all cases, and referring to FIGS. 8 and 9, the counterbalance causes preferential orientation of the element associated therewith such that the counterbalance is at the lowermost position when pivoted to :another element in the series. That is to say, for example, rear legs 74 would not maintain the outwardly projecting orientation in the face of the gravity absent some sort of contravention. That contravention comes in the form of a counterbalance weight as shown in FIG. 3, located at an extremity of the leg, remote from the foot.

Similarly, the counterweight 90 is placed at an extremity of the tail 54 remote from the tail's tip. The arm 86 of the cowboy is held outwardly by means of a counterbalance 90 placed near the base of the cowboy's shirt. The arm 92 of the cowboy holding the hat maintains the hat in a high energy position by means of a counterbalance located at the shoulder of the arm. The head 78 of the bull maintains the horns in an upwardly projecting position by means of a counterbalance 90 adjacent the area where the head connects with the neck. The portion of the neck 52 as it attaches to the front quarter 42 keeps the neck projected upwardly and outwardly by means of a counterbalance 90 located at a portion of the neck remote from the head 78. Viewed at its broadest, the front quarter 42 is counterbalanced by pendulum 22.

A natural corollary of maintaining these portions of the figurine in an artificial position by means of the counterbalance includes that when the animated figurine is in motion, those elements provided with the counterbalance are least affected by the motion of the pendulum and provide inherent damping of the arcuate motion associated with each of the pivoted elements. As a consequence, these counterbalanced elements try to maintain the lowermost energy position in which the counterbalance is at its lowermost position. When the pendulum switches direction, the elements having the counterbalance are also the least responsive to changes in motion so that the noncounterbalanced elements, such as cowboy leg 76 and ears 82 have more extreme ranges of motion and provide arcuate motion about its respective pivot having a greater included angle. In other words, the uncounterbalanced links swing through a greater arc than a counterbalanced link since the counterbalance wants to maintain a constant position relative to vertical.

FIGS. 10 through 13 reflects a horse and rider combination that provides interesting contrasts with the previously discussed bull and rider, with only the salient differences between the two discussed hereinafter. Areas of commonality will not be belabored.

Figure 7:
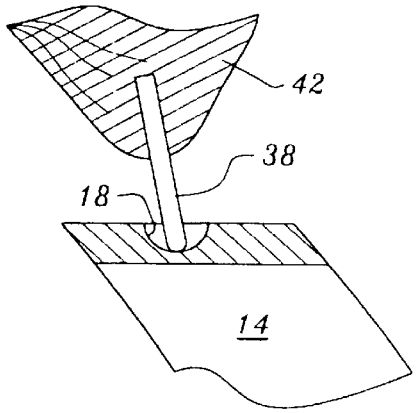
FIG. 7 is a section along lines 7—7 of FIG. 6.

One most evident difference is that the pins 38 which support the figurine (FIGS. 10 through 13) extend from the rear legs of the horse and not the front legs as in the bull. However in both cases, the pins 38 rest within the hemispherical cups 18 (FIGS. 6 and 7) to prevent the rocking figurine from walking along the fulcrum 16. Because the pins 38 extend from the rear legs of the horse, the rear legs (e.g. the hind quarters) define the mass in FIGS. 10 through 13. In addition, in FIGS. 10 through 13, the tail, neck, head of the horse and the arms of the rider are all counterbalanced. Similar to the bull version, the legs of the rider are not counterbalanced. Note the horse's front legs are preferably not counterbalanced. Furthermore, the torso of the rider is fixed with relation to the main mass, in this case the hind quarter of the horse. Note also that the cowboy in FIGS. 10 through 13 is not holding his hat in his hand, but instead, the hat is disposed on the torso. In addition, one hand of the cowboy in FIGS. 10 through 13 holds a reins 101 that extend between one hand and the head of the horse. The reins 101 are fixed in position by holes 103 in the head of the horse and hole 105 in the hand of the rider, and motion between the horse's head and the arm of the cowboy induces motion in the rein.

In FIGS. 10 through 13, notice the curve in the support arms 14 of stand 20. In both the variations with the bull and the horse, the support arms 14 have a radius of curvature where the center of the radius curvature is shown as extending towards the left of the page, where "left" is for the mere convenience of the ensuing discussion. In both cases, the head of the animal is in the same direction of the radius of curvature. However, because the horse's pins depend from the rear legs, the horse appears to project further to the left of the drawings than the bull does. One of the characteristics of the structure in both cases is that the fulcrum 16 is so thin and that the curvature of the arcuate rod 26 is anchored and well within the mass, and well above the fulcrum 16, so that either the horse or the bull could have been rotated 180° such that the head of the animal faces to the right instead of the left. This is due to the thinness of the fulcrum 16 and the clearance that the arcuate rod 26 provides by its connection up to the mass. Thus, the animated figurine is adapted to face in either direction. And, as mentioned, the presence of the cup 18 and the location of the pins 38 therewithin prevent the animated figurine from "walking" on the fulcrum which is to say that the rocking motion would tend to cause the pins to move along the fulcrum. The utilization of the cup prevents the pins from moving along the fulcrum that holds the figurine in place.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. An oscillating toy comprising in combination:

a pendulum, a mass operatively coupled to said pendulum whereby motion of said pendulum imparts motion to said mass, a fulcrum supporting said mass about which the motion occurs, a link rotationally connected to said mass by a pivot and free to rotate about said pivot in response to pendulum motion, said fulcrum formed from a pair of spaced hemispherical cups disposed on a stand upon which said mass is supported, with two pins extending from said mass, one within each said cup.

2. The toy of claim 1 where said link is formed from plastic or wood.

3. The toy of claim 1 including counterbalance means disposed on said link.

4. The toy of claim 1 wherein said mass is formed from two pieces which sandwich said anchor.

5. The toy of claim 4 wherein one of two legs of a cowboy pivot to an outer face of one of said two pieces.

6. The toy of claim 5 wherein said toy is configured as a four legged animal, two legs of said animal attached to said mass by pivots on said outer faces of said mass.

7. The toy of claim 6 wherein said mass includes two animal legs.

8. The toy of claim 7 wherein an animal neck and tail are pivotally sandwiched between said mass.

9. The toy of claim 8 wherein an animal face is formed from two parts which pivotally attach to said neck on outer surfaces thereof.

10. The toy of claim 9 including two rider arms located on two sides of a rider torso which is sandwiched between said mass two pieces.

11. The toy of claim 10 wherein said toy is a bull and bull rider.

12. The toy of claim 10 wherein said toy is a horse and rider.

13. An oscillating toy comprising in combination:

a pendulum, a mass operatively coupled to said pendulum whereby motion of said pendulum imparts motion to said mass, a fulcrum supporting said mass about which the motion occurs, a link rotationally connected to said mass by a pivot and free to rotate about said pivot in response to pendulum motion, counterbalance means on said link such that link rotation about said pivot is resisted due to said counterbalance means, and a further link without counterbalance means.

14. The toy of claim 13 where said link is formed from plastic or wood.

15. The toy of claim 13 including counterbalance means disposed on said link.

16. The toy of claim 13 wherein said mass is formed from two pieces which sandwich said anchor.

17. The toy of claim 16 wherein one of two legs of a cowboy pivot to an outer face of one of said two pieces.

18. The toy of claim 17 wherein said toy is configured as a four legged animal, two legs of said animal attached to said mass by pivots on said outer faces of said mass.

19. The toy of claim 18 wherein said mass includes two animal legs.

20. The toy of claim 19 wherein an animal neck and tail are pivotally sandwiched between said mass.

21. The toy of claim 20 wherein an animal face is formed from two parts which pivotally attach to said neck on outer surfaces thereof.

22. The toy of claim 21 including two rider arms located on two sides of a rider torso which is sandwiched between said mass two pieces.

23. The toy of claim 22 wherein said toy is a bull and bull rider.

24. The toy of claim 22 wherein said toy is a horse and rider.

25. An oscillating toy comprising in combination:

a pendulum, a mass operatively coupled to said pendulum whereby motion of said pendulum imparts motion to said mass, a fulcrum supporting said mass about which the motion occurs, a link rotationally connected to said mass by a pivot and free to rotate about said pivot in response to pendulum motion, and counterbalance means on said link such that link rotation about said pivot is resisted due to said counterbalance means, wherein said counterbalance means includes a portion of said link having a density greater than a remainder of said link.

26. The toy claim 25 where said link is formed from plastic or wood.

27. The toy of claim 25 wherein said counterbalance means is located at an extremity of said link.

28. The toy of claim 25 including counterbalance means disposed on said link.

29. The toy of claim 25 wherein said mass is formed from two pieces which sandwich said anchor.

30. The toy of claim 29 wherein one of two legs of a cowboy pivot to an outer face of one of said two pieces.

31. The toy of claim 30 wherein said toy is configured as a four legged animal, two legs of said animal attached to said mass by pivots on said outer faces of said mass.

32. The toy of claim 31 wherein said mass includes two animal legs.

33. The toy of claim 32 wherein an animal neck and tail are pivotally sandwiched between said mass.

34. The toy of claim 33 wherein an animal face is formed from two parts which pivotally attach to said neck on outer surfaces thereof.

35. The toy of claim 34 including two rider arms located on two sides of a rider torso which is sandwiched between said mass two pieces.

36. The toy of claim 35 wherein said toy is a bull and bull rider.

37. The toy of claim 35 wherein said toy is a horse and rider.

38. An oscillating toy comprising in combination:

a pendulum, a mass operatively coupled to said pendulum whereby motion of said pendulum imparts motion to said mass, a fulcrum supporting said mass about which the motion occurs, a link rotationally connected to said mass by a pivot and free to rotate about said pivot in response to pendulum motion, and counterbalance means on said link such that link rotation about said pivot is resisted due to said counterbalance means, wherein said counterbalance means is formed from a weight disparately greater than a remainder of said link.

39. The toy of claim 38 where said link is formed from plastic or wood.

40. The toy of claim 38 including counterbalance means disposed on said link.

41. The toy of claim 38 wherein said mass is formed from two pieces which sandwich said anchor.

42. The toy of claim 41 wherein one of two legs of a cowboy pivot to an outer face of one of said two pieces.

43. The toy of claim 42 wherein said toy is configured as a four legged animal, two legs of said animal attached to said mass by pivots on said outer faces of said mass.

44. The toy of claim 43 wherein said mass includes two animal legs.

45. The toy of claim 44 wherein an animal neck and tail are pivotally sandwiched between said mass.

46. The toy of claim 45 wherein an animal face is formed from two parts which pivotally attach to said neck on outer surfaces thereof.

47. The toy of claim 46 including two rider arms located on two sides of a rider torso which is sandwiched between said mass two pieces.

48. The toy of claim 47 wherein said toy is a bull and bull rider.

49. The toy of claim 47 wherein said toy is a horse and rider.

50. An oscillating toy comprising in combination:

a pendulum having a magnetic element, a mass operatively coupled to said pendulum whereby motion of said pendulum imparts motion to said mass, a fulcrum supporting said mass about which the motion occurs, and a link rotationally connected to said mass by a pivot and free to rotate about said pivot in response to pendulum motion, said fulcrum coupled to a base at a different elevation, said base including a magnetic couple to react with said pendulum magnetic element, as said pendulum passes over said base, wherein said magnetic couple includes a battery operatively coupled to a magnet which is enabled by said battery.

51. The toy of claim 50 including counterbalance means disposed on said link.

52. The toy of claim 50 where said link is formed from plastic or wood.

53. The toy of claim 50 wherein said mass is formed from two pieces which sandwich said anchor.

54. The toy of claim 53 wherein one of two legs of a cowboy pivot to an outer face of one of said two pieces.

55. The toy of claim 54 wherein said toy is configured as a four legged animal, two legs of said animal attached to said mass by pivots on said outer faces of said mass.

56. The toy of claim 55 wherein said mass includes two animal legs.

57. The toy of claim 56 wherein an animal neck and tail are pivotally sandwiched between said mass.

58. The toy of claim 57 wherein an animal face is formed from two parts which pivotally attach to said neck on outer surfaces thereof.

59. The toy of claim 58 including two rider arms located on two sides of a rider torso which is sandwiched between said mass two pieces.

60. The toy of claim 59 wherein said toy is a bull and bull rider.

61. The toy of claim 59 wherein said toy is a horse and rider.

62. An oscillating toy comprising in combination:

a pendulum, a mass operatively coupled to said pendulum whereby motion of said pendulum imparts motion to said mass, a fulcrum supporting said mass about which the motion occurs, and a link rotationally connected to said mass by a pivot and free to rotate about said pivot in response to pendulum motion, said mass coupled to said pendulum by an arcuate rod extending therebetween, wherein said arcuate rod terminates in an anchor on said mass.

63. The toy of claim 62 wherein said mass is formed from two pieces which sandwich said anchor.

64. The toy of claim 63 wherein one of two legs of a cowboy pivot to an outer face of one of said two pieces.

65. The toy of claim 64 wherein said toy is configured as a four legged animal, two legs of said animal attached to said mass by pivots on said outer faces of said mass.

66. The toy of claim 65 wherein said mass includes two animal legs.

67. The toy of claim 66 wherein an animal neck and tail are pivotally sandwiched between said mass.

68. The toy of claim 67 wherein an animal face is formed from two parts which pivotally attach to said neck on outer surfaces thereof.

69. The toy of claim 68 including two rider arms located on two sides of a rider torso which is sandwiched between said mass two pieces.

70. The toy of claim 69 wherein said toy is a bull and bull rider.

71. The toy of claim 69 wherein said toy is a horse and rider.

72. The toy of claim 12 where said link is formed from plastic or wood.

73. The toy of claim 12 including counterbalance means disposed on said link.

* * * * *